US005791639A

United States Patent [19]

Johnston et al.

[11] Patent Number: 5,791,639

[45] Date of Patent: Aug. 11, 1998

[54] FRAMING MEMBER SUPPORT STAND

[76] Inventors: Russell M. Johnston, 975 Harriet Ave., Shoreview, Minn. 55126; John W. Krispin, 322 W. County Rd. B, St. Paul, Minn. 55113

[21] Appl. No.: 562,706

[22] Filed: Nov. 27, 1995

[51] Int. Cl.[6] ..... B25B 5/14

[52] U.S. Cl. ..... 269/41

[58] Field of Search ..... 259/8 B, 7 B, 259/129, 126, 133 A; 269/41, 43, 45, 46, 37, 69, 904; 248/161, 165, 166, 170

[56] References Cited

U.S. PATENT DOCUMENTS

| | | | |
|---|---|---|---|
| 1,946,034 | 2/1934 | Ramsay | 254/126 |
| 2,490,858 | 12/1949 | Deddo | 248/165 |
| 2,524,916 | 10/1950 | Loos | 269/46 |
| 4,061,302 | 12/1977 | Boone | 248/170 |
| 4,899,985 | 2/1990 | Good | 254/8 B |
| 5,090,648 | 2/1992 | Wood | 248/161 |
| 5,100,283 | 3/1992 | Carty | 254/8 B |
| 5,192,059 | 3/1993 | Silver | 269/45 |

*Primary Examiner*—Robert C. Watson

[57] ABSTRACT

An articulating and telescoping assembly for temporarily supporting construction framing members. A base includes a number of radially directed sockets which receive detachable stabilizers. A telescoping stanchion pivots at the base and supports a gimbaled workpiece holder having support saddles, which holder is also vertically adjustable along the stanchion. A length adjustable brace pivots at the base and is vertically adjustable along the stanchion at a clamp to determine a plumb angle of the stanchion. Alternative constructions of the workpiece holders, holder support clamp, brace, stanchion pivots, and stanchion extenders are disclosed.

17 Claims, 4 Drawing Sheets

FRAMING MEMBER SUPPORT STAND

BACKGROUND OF THE INVENTION

The present invention relates to temporary workpiece supports and, in particular, to an assembly for supporting beams or framing members in a level condition as vertical and other supports are added during the framing of a surrounding superstructure.

A problem commonly encountered in construction framing is that of having to temporarily support primary load bearing beams or framing members in a level condition during the initial construction of a framed structure. The length and weight of such members make it particularly difficult to support the members in a fashion which maintains a desired elevation and level condition as the member is adjusted to its proper geometrical orientation to the frame structure and before the permanent vertical supports are secured to the horizontal supports.

For example, when framing outdoor decks or a floor system, it is frequently necessary to support multiple manufactured beams, trusses, 2×12's or possibly 4×6 or 6×10 beams, at lengths of twenty to thirty feet, in a level and plumb condition as additional framing members are attached to permanently support the primary support members. Temporary scaffolds can be erected or hydraulic equipment, such as a backhoe or front-end loader, might be used, if available to support the beams. For many projects, however, such equipment is not available or at least not at a reasonable cost in relation to projects such as the construction of a deck or pole-barn building.

Sawhorses and other low level supports do not provide sufficient height to retain the framing members, nor do they readily permit adjustment to properly establish level and plumb conditions at the members. Some of these supports are shown at U.S. Pat. Nos. 2,702,727; 2,297,316; and 5,064,156.

Lifting jacks or temporary supports have also been developed to retain cabinets in place as they are mounted to walls and ceilings. The principal concern with such supports is to obtain a desired elevation to retain the cabinet against an adjoining wall or ceiling as the cabinet is fastened in place. The supports need not establish a level and plumb condition for the cabinet. U.S. Pat. Nos. 4,340,205; 4,715,760; and 4,955,592 disclose devices of the latter type.

In appreciation of the foregoing deficiencies, the subject invention was developed to provide a stable, temporary support which when used in pairs or with other supports restrains one or more beams in a level and plumb condition. Each beam is supported in a fashion which permits adjustments to bring each beam into proper alignment to each other, any existing frame structure or the structure being assembled. The plumb, level and elevation of each support is retained throughout the process although can periodically be re-adjusted as necessary.

SUMMARY OF THE INVENTION

It is accordingly a primary object of the present invention to provide an articulating, temporary support stanchion for a workpiece such as a framing member.

It is a further object of the invention to provide a support having a telescoping stanchion which contains one or more adjustable workpiece holders.

It is a further object of the invention to provide workpiece holders which are retained to the stanchion at clamp restraints which permit the holders to pivot along two axes.

It is a further object of the invention to provide workpiece holders having means for separately adjusting elevation.

It is a further object of the invention to provide a stanchion brace which is pivotally mounted to a base support and which is fitted to the stanchion to permit adjustment of the stanchion plumb angle.

It is a further object of the invention to provide a length adjustable brace which is slide coupled to the stanchion.

It is a further objection of the invention to provide a base support that is capable of receiving a number of removable stabilizers or legs.

Various of the foregoing objects, advantages and distinctions are obtained in the following presently preferred construction. The support provides a base plate having a number of sockets which receive radially directed stabilizers. Pivotally supported to the base plate is a multi-section stanchion and the sections of which are telescopically mounted to one another. One or more workpiece supports are restrained to the stanchion with spring biased clamps. Pivot joints at the supports permit a multi-axis adjustment of each support. A length extensible brace is pivotally mounted to the base at one end and slide mounted along the stanchion at an opposite end. Adjustment of the brace varies the plumb angle of the stanchion, which angle is retained upon setting a restraint at the coupling between the brace and stanchion.

In various constructions, the brace and/or stanchion can include hydraulic cylinders to vary the extension of the brace and/or stanchion. The brace and/or stanchion can be fitted to a pivot axle formed at a base plate. The workpiece holders may also provide a screw follower attachment to the stanchion, such as at a "ball screw" collar mounted to a threaded end of the stanchion.

Still other objects, advantages and distinctions of the invention will become more apparent from the following description. To the extent various modifications and improvements have been considered, they are described as appropriate. The description should not be literally construed in limitation of the scope of the invention. Rather, the invention should be interpreted within the scope of the further appended claims.

DESCRIPTION OF THE PREFERRED EMBODIMENT

Figure 1:
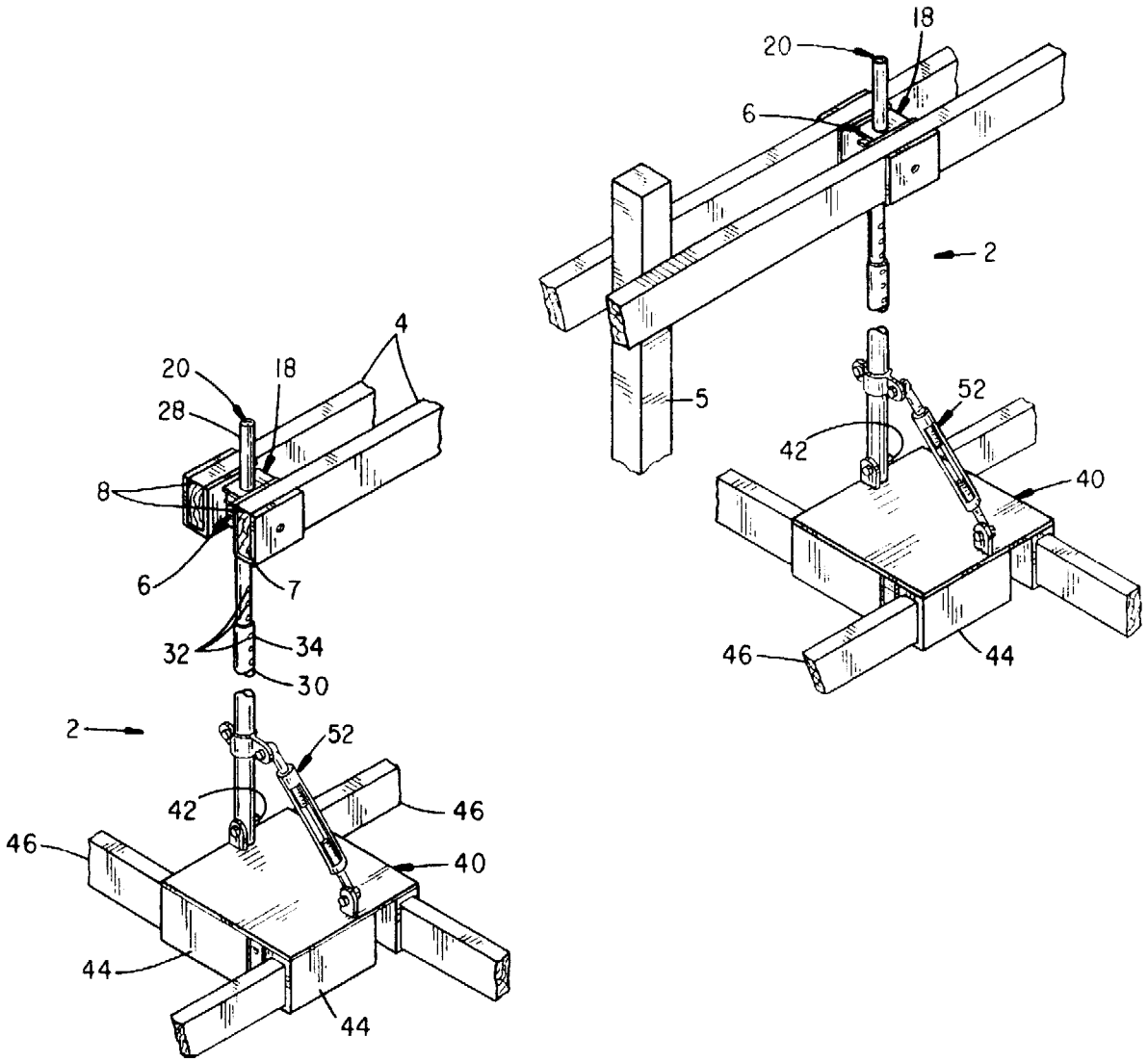
FIG. 1 is a perspective drawing of a pair of supports holding a pair of load bearing beams such as for an outdoor deck.

Referring to FIG. 1, a pair of framing supports 2 of the invention are shown as they typically appear when supporting one or more load bearing beams 4 for a deck, floor system or other superstructure. Each support 2 provides a workpiece holder 6, which holders 6 are typically configured to contain a pair of saddles 8 and dimensioned to support framing members of a two inch edge width. The holders 6 support the members in a preferred level and plumb condition relative to the ground or support surface. Once the mounting position of the beams 4 is determined, permanent vertical supports 5 and the like can be readily mounted to the beams 4. Advantageously, all activities can be accomplished by a single person, without the need for heavy equipment.

Depending on the supported frame members 4, the width of the channel space 7 at each saddle 8 can be appropriately sized. That is, lengths of channel stock having a width appropriate to the beam 4 can be substituted to each holder 6 to fit a desired beam width. Although two saddles 8 are shown at each holder 6, a single saddle 8 can also be used.

Figure 4:
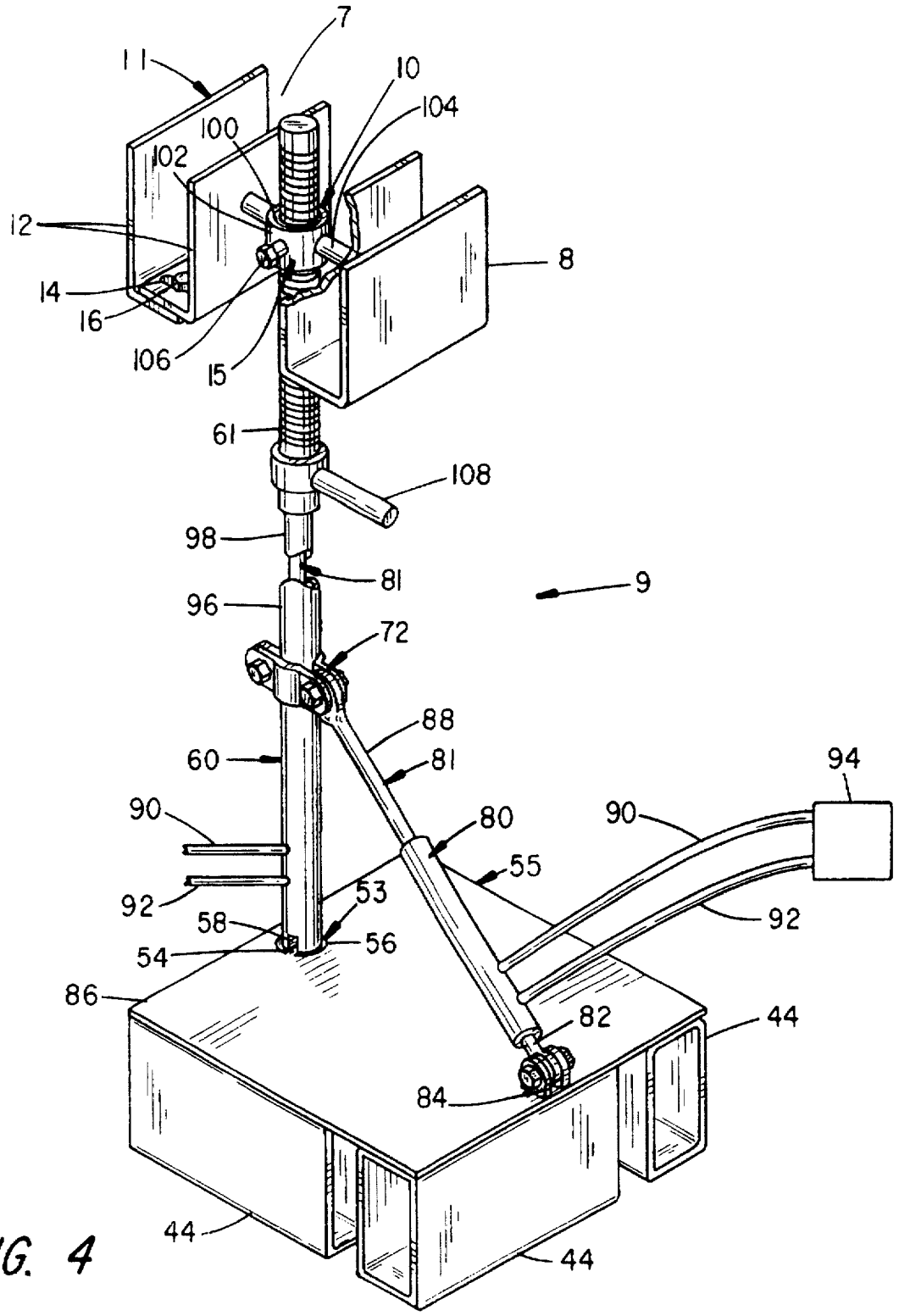
FIG. 4 is a perspective view to an alternative support having a pneumatically extended brace and/or stanchion.

Alternatively and with attention to an alternative support 9 and holder 10 shown at FIG. 4, a width adjustable saddle 11 can be used. The channel 7 of the saddle 11 is defined by a pair of overlapping angle members 12. A slot 14 and through fastener 16 are mounted to the slot 14 to permit adjustment of the spacing of the channel 7. The saddle 11 can thus be adjusted to accommodate beams 4 of a variety of widths.

Figure 3:
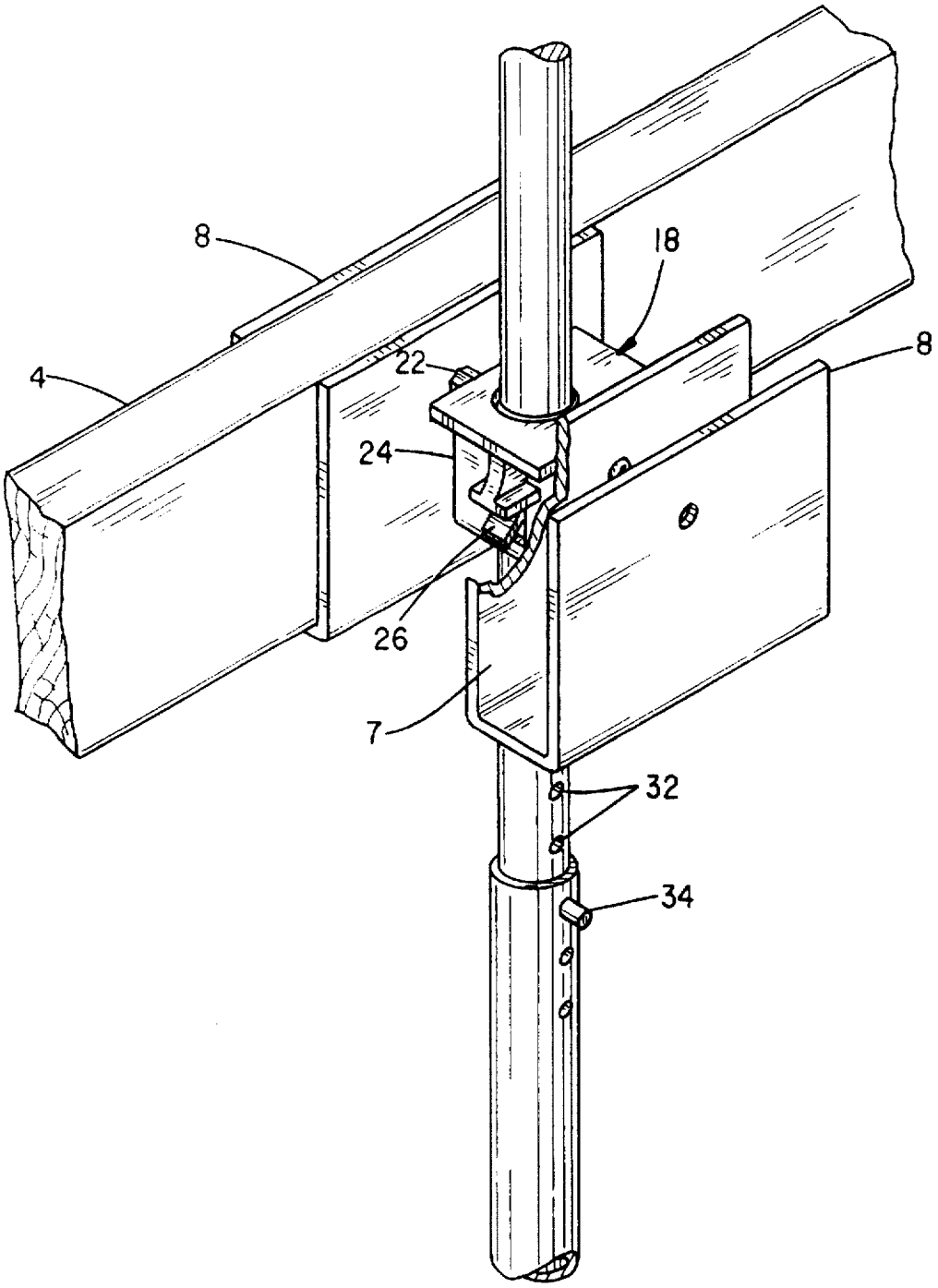
FIG. 3 is a perspective view to a double saddle workpiece holder.

The elevation of each holder 6 is determined by a clamp assembly 18 which is fitted to a vertical stanchion 20. A pair of pivot axles 22, one of which is shown at FIG. 3, extend from a clamp body 24 of each clamp 18 and mount to each saddle 8. The axles 22 provide a gimbaled mounting and permit rotation of the beams 4 and saddles 8 toward one another. The saddles 8 are thereby able to adjust to possible mis-alignment of the beams 4 as they are initially fitted to the supports 2. That is, the saddles 8 are able to rotate longitudinally to accommodate the spacing between the supports 2, without inducing tipping. The ends of the axles 22 at the coupling to the saddles 8 are presently of a stationary mount. For some applications a separate pivot may be provided to permit the saddles 8 to pivot toward and away from the stanchion 20.

A desired elevation for each beam 4 is determined with the clamp 18. Once the initial stanchion elevation is established, elevation adjustments at the holders 6 can be made by releasing a clamp arm 26, which has a serrated or knurled surface (not shown) that engages the stanchion 20, and raising or lowering the clamp body 24 and attached saddles 8, before re-securing the clamp arm 26 to the stanchion 20.

As presently constructed, the clamp 18 is constructed from a modified stationary clamp end of a conventional pipe clamp. A variety of other clamps which can be fitted to the stanchion 20 and permit vertical adjustments to the saddles 8 may alternatively be used. One alternative "ball screw" clamp 15 that can be fitted to the saddle 10 and a threaded end of the stanchion 20 is discussed below at FIG. 4.

The initial elevation of each clamp 18 is determined by the extension of the stanchion 20. That is, each stanchion 20 is constructed of multiple sections 28, 30, which telescope from one another. The stanchion 20 of FIG. 1, which is shown in detail at FIG. 3, provides a number of holes 32 which can be aligned to receive a lynch pin 34. Upon setting the extension of the sections 28, 30, the clamps 18 are adjusted to a working height which as necessary can be varied with the aid of the clamp arms 26 as discussed above.

Figure 2:
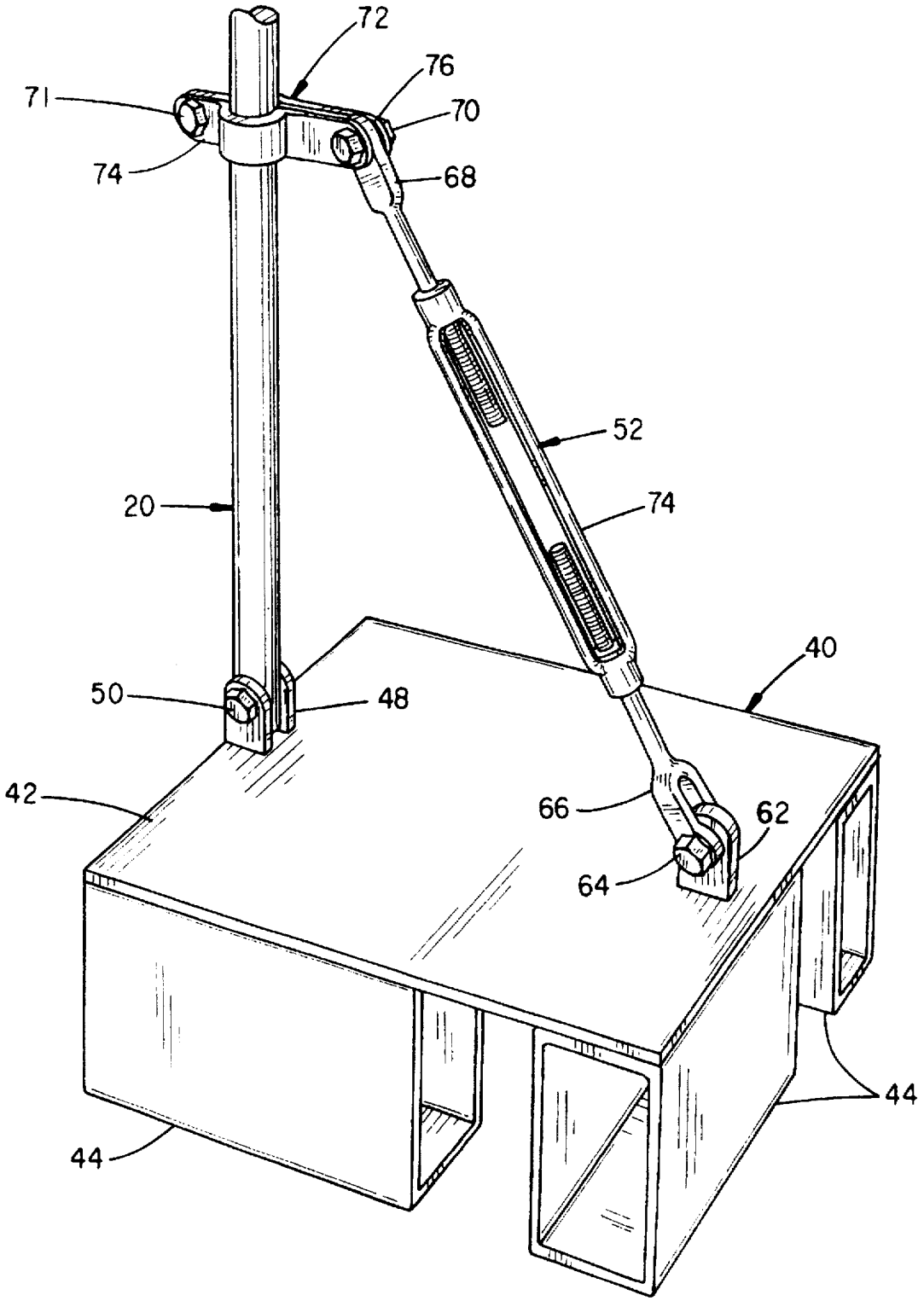
FIG. 2 is a perspective view of the base and the brace in relation to a cut away portion of the stanchion.

With additional attention to FIG. 2, each support 2 is anchored at a base assembly 40 having a base plate 42 and to a bottom surface of which a number of radially directed tubular sockets 44 are fitted. The sockets 44 are formed from lengths of channel stock that are welded to the base plate 42. The sockets 44 are sized and positioned to receive a number of stabilizers 46, such as stub pieces of 2×4's or other available framing pieces, which stabilizers 46 provide support legs for each support 2.

Any number of stabilizers 46 can be fitted to each support 2 to stabilize each support 2 against undesired tipping forces. The sockets 44 can be positioned at any desired orientation to the base plate and can also be sized to receive sections of tubular pipe. Once each support 2 is positioned, fasteners, such as nails or ground pegs, can be secured through the stabilizers 46 to contain each support 2 in an established orientation.

A bracket 48 projects from the base plate 42 to support the stanchion 20 at an axle 50. The axle 50 permits the plumb angle of the stanchion 20 to be varied in relation to a brace 52 that mounts between the base plate 42 and the stanchion 20.

A variety of pivot assemblies can be provided to vary the plumb angle at the stanchion 20. An example of an alternative pivot assembly 53 and axle 54 is shown at the base assembly 55 of FIG. 4. The axle 54 is formed from the base plate as a section of material which extends across a pair of half moon cutouts 56. A slot 58 at the stanchion 60 is supported to the axle 54 and the stanchion 60 is free to rotate as the plumb angle is established at the brace 80.

A turnbuckle brace 52 extends between the stanchion 20 and a second pivot bracket 62. A fastener 64 serves as a pivot axle to one threaded end 66 of the brace 52. An opposite threaded end 68 is secured to a fastener 70 of a clamping collar assembly 72 at the stanchion 20. The fasteners 64 and 70 provide two pivot points which facilitate the plumb adjustment of the stanchion, and which accommodate the adjustment of the stanchion 20 to uneven support surfaces. Upon rotating a body 74 of the turnbuckle brace 52, the brace 52 extends and retracts to accommodate changes in the plumb angle of the stanchion 20.

The collar 72 includes a pair of semi-circular pieces 74, 76 which mount about the stanchion 20. The fasteners 70 and 71 secure the pieces 74, 76 together and once set, retain the collar 72 to the stanchion 20. Depending upon the adjustments to the brace body 74, the collar 72 is raised or lowered.

During the initial setup of the support 2, the collar 72 is loosely secured to the stanchion 20 and the brace 52 is adjusted to set the stanchion 20 plumb to the ground or support surface. Once a plumb condition is established, the fasteners 70, 71 are set and the condition is retained. Further adjustments can then be made at the holders 6 to establish a proper elevation and level condition.

Returning attention to the alternative support 9 at FIG. 4, the stanchion 60 is supported at a brace 80 which is constructed from a hydraulic or pneumatic cylinder 81. A cylinder end 82 is pivotally supported to a bracket 84 at the base plate 86 and a piston 88 is secured to a collar 72 at the stanchion 60. Appropriate supply and return lines 90, 92 extend from a controller 94 to vary the extension of the piston 88. With the setting of an appropriate extension, the collar 72 is set to fix the plumb condition of the stanchion 60.

In lieu of a lynch pin mounting, a second cylinder 81 is also fitted within the stanchion 60 to upper and lower telescoping sections 96, 98 to extend and retract the section 98 as desired via the controller 94.

As mentioned, the holder 10 of FIG. 4 also provides an adjustable "ball screw" clamp 15. Ball screws are generally known and are available from a number of suppliers. The clamp 15 is constructed from a modified ball screw and includes an inner race 100 which is threaded to a threaded extension 61 of the stanchion section 98. An outer race 102, which is separated from the inner race by a number of ball bearings (not shown), contains a pair of axles 104 and a set screw 106. The end of the axles 104 mounted to the race 104 permit longitudinal rotation of the saddles 8. Fasteners at the opposite end of the axles 104 fit through oversized holes in the saddles 8, 11 loosely retain the saddles 8, 11 and permit rotation toward and away from the stanchion 60.

The clamp 15 advantageously supports the saddles 8, 11 in a screw follower fashion to the stanchion 60. That is, the elevation of the holder 10 can be adjusted by either rotating the holder 10 and outer race 102 or by rotating the threaded extension 61. Prior to placement of the beams 4, the initial position of the holder 10 is established by rotating the holder 10. Once the beams 4 are set and which stabilizes the races 102, 104 against inadvertent rotation, the extension 61 is rotated with the aid of a handle 108 that mounts to the threaded extension 61 at the section 98. The beams 4 can thereby be adjusted to a final desired elevation with relative ease by merely rotation the stanchion 60, which rotation is also accommodated by the piston at the cylinder 81.

Although particular arrangements of adjustable braces 52, 80, stanchions 20 and 60, and clamps 18 and 10 are shown, it is to be appreciated different combinations can be included in a preferred support.

While the invention has been described with respect to a presently preferred construction and considered modifications and improvements, it is to be appreciated still other constructions may be suggest to those skilled in the art. The invention therefore should be broadly interpreted to include all those equivalent embodiments within the spirit and scope of the following claims.

What is claimed is:

1. Support apparatus comprising:

a) a base having a plurality of tubular sockets fitted to a base plate and wherein each of said sockets is adapted to receive a horizontal stabilizer;

b) a vertical stanchion secured to said base plate at a pivot means;

c) a brace and means for securing said brace to said stanchion and to said base plate to define a plumb angle therebetween and wherein said brace includes first and second members mounted in length extensible relation to one another; and d) a workpiece holder including a collar mounted to said stanchion and a spring biased clamp arm mounted to said collar to engage said stanchion and whereby the workpiece holder can be adjusted along said stanchion.

2. Apparatus as set forth in claim 1 wherein a saddle having a channel is supported to pivot at an axle which extends from said collar holder.

3. Apparatus as set forth in claim 2 wherein said saddle comprises first and second angle members and means for displacing the angle members from one another to define a variable width channel therebetween.

4. Apparatus as set forth in claim 1 wherein said brace comprises a turnbuckle having first and second portions which extend relative to one another and wherein the first portion is mounted to said base and the second portion is secured to said stanchion.

5. Apparatus as set forth in claim 4 wherein said at least one of said first and second portions is mounted to pivot.

6. Apparatus as set forth in claim 1 wherein said stanchion comprises a plurality of sections which telescope from one another and including means for adjusting the relative displacement of said sections to one another.

7. Apparatus as set forth in claim 6 wherein said plurality of sections include a plurality of apertures and which apertures selectively align to receive a lynch pin.

8. Apparatus as set forth in claim 1 wherein said stanchion includes a cylinder and a piston mounted between said base and said workpiece holder and means for extending and retracting said piston relative to said cylinder to vary the elevation of the workpiece holder.

9. Apparatus as set forth in claim 8 wherein said brace means includes a cylinder and a piston mounted to said base and to said stanchion and means for extending and retracting said piston relative to said cylinder to vary the plumb angle of said stanchion.

10. Apparatus as set forth in claim 1 wherein an end of said stanchion includes a slot fitted to an axle portion of said base plate.

11. Apparatus as set forth in claim 1 wherein the workpiece holder restraint means comprises a ball screw means having first and second races separated by a plurality of bearings and wherein one of said first and second races is fitted to a threaded portion of said stanchion.

12. Apparatus as set forth in claim 11 wherein an axle extends from the other of said first and second races and wherein said workpiece holder is pivotally mounted to said axle.

13. Support apparatus comprising:

a) a base having a plurality of tubular sockets fitted to a base plate and wherein each of said sockets is adapted to receive a stabilizer;

b) a vertical stanchion secured to said base plate at a first pivot means;

c) a brace secured to said base plate at a second pivot means and clamp means for adjustably retaining said brace to said stanchion to define a plumb angle therebetween and wherein said brace includes first and second members mounted in length extensible relation to one another; and d) a workpiece holder including a ball screw means having first and second races separated by a plurality of bearings, wherein one of said first and second races is fitted to a threaded portion of said stanchion and wherein a saddle is mounted to pivot at an axle which extends from the other of said first and second races.

14. Apparatus as set forth in claim 13 wherein said stanchion comprises a plurality of sections which telescope from one another and including means for adjusting the relative displacement of said sections to one another.

15. Apparatus as set forth in claim 14 wherein said brace comprises a turnbuckle having first and second threaded extensions which mate with an intermediate body, wherein one of said first and second extensions is pivotally mounted to said base, and wherein the other of said first and second extensions is secured to said stanchion at a clamp means.

16. Support apparatus comprising:

a) a base having a plurality of tubular sockets fitted to a base plate and wherein each of said sockets is adapted to receive a stabilizer;

b) a vertical stanchion secured to said base plate at a first pivot means and comprising a plurality of sections which telescope from one another and including means for adjusting the relative displacement of said sections to one another;

c) a brace comprising a turnbuckle having first and second threaded extensions which mate with an intermediate body, wherein one of said first and second extensions is pivotally secured to said base plate at a second pivot means, and wherein the other of said first and second extensions is secured to said stanchion at a clamp means for adjustably retaining said brace to said stanchion to define a plumb angle therebetween; and d) a workpiece holder including a collar mounted to said stanchion and having a spring biased clamp arm mounted to engage said stanchion and wherein a support saddle is mounted to pivot from an axle which extends from said collar and whereby the holder workpiece can be adjusted along said stanchion.

17. Support apparatus comprising:

a) a base having a plurality of tubular sockets fitted to a base plate and wherein each of said sockets is adapted to receive a stabilizer;

b) a vertical stanchion secured to said base plate at a first pivot means and comprising a plurality of sections which telescope from one another and including means for adjusting the relative displacement of said sections to one another;

c) a brace and means for securing said brace to said stanchion and to said base plate to define a plumb angle therebetween and wherein said brace includes first and second members mounted in length extensible relation to one another; and d) a workpiece holder including a ball screw means having first and second races separated by a plurality of bearings, wherein one of said first and second races is fitted to a threaded portion of said stanchion and wherein the workpiece holder is mounted to the other of said first and second races.

* * * * *